United States Patent [19]

Ditton

[11] Patent Number: 4,582,198

[45] Date of Patent: Apr. 15, 1986

[54] WIRE SHIPPING AND DISPENSING PACKAGE

[75] Inventor: Louis G. Ditton, Fort Wayne, Ind.

[73] Assignee: Essex Group, Inc., Fort Wayne, Ind.

[21] Appl. No.: 703,232

[22] Filed: Feb. 19, 1985

[51] Int. Cl.[4] ..... B65D 85/67

[52] U.S. Cl. ..... 206/395; 206/389; 206/408; 206/503; 206/508; 206/515; 206/516; 229/39 R; 229/DIG. 11

[58] Field of Search ..... 206/303, 320, 326, 389, 206/395, 408, 499, 503, 505, 508, 509, 515, 516; 229/23 R, 37, 38, 39, 44 R, DIG. 11

[56] References Cited

U.S. PATENT DOCUMENTS

| | | | |
|---|---|---|---|
| 1,800,841 | 4/1931 | Maston | 206/516 |
| 2,462,693 | 2/1949 | Wabshaw | 206/505 |
| 2,835,432 | 5/1958 | Wilmot | 229/39 R |
| 2,863,596 | 12/1958 | Harrison | 206/509 |
| 2,903,173 | 9/1959 | Hopkins | 229/44 R |
| 3,000,493 | 9/1961 | Hirst | 242/170 |
| 3,001,642 | 9/1961 | Hirst | 206/407 |
| 3,062,426 | 11/1962 | Mason | 229/39 R |
| 3,096,951 | 7/1963 | Jenson | 242/137.1 |
| 3,253,765 | 5/1966 | Train | 229/23 R |
| 3,491,876 | 1/1970 | Zecchin | 206/395 |
| 3,623,634 | 11/1969 | Norgard | 206/509 |
| 3,635,361 | 1/1972 | Hayes | 229/DIG. 11 |
| 3,696,966 | 10/1972 | Herolzer | 206/509 |
| 3,811,639 | 5/1974 | Jordan | 242/129.8 |
| 3,823,894 | 7/1974 | Frederick et al. | 242/137.1 |
| 4,146,169 | 3/1979 | Meyers et al. | 229/37 R |
| 4,161,248 | 7/1979 | Kalmanovitch | 206/383 |
| 4,201,300 | 5/1980 | Klingaman et al. | 206/395 |
| 4,397,415 | 8/1983 | Lisiecki | 229/37 R |
| 4,451,014 | 5/1984 | Kitt et al. | 242/128 |

*Primary Examiner*—Joseph Man-Fu Moy
*Assistant Examiner*—David T. Fidei
*Attorney, Agent, or Firm*—Robert D. Sommer

[57] ABSTRACT

In a wire shipping and dispensing package comprising a wire-carrying spool disposed vertically in a generally rectangular carton having side and end walls extending upwardly from a substantially square bottom section to define a substantially square open top, the lower end portion of the carton is adapted to frictionally fit within the upper end portion of a substantially identical carton disposed therebelow. A pad sheet is removably secured in the open top of the carton in engagement with the rim of an upwardly cupped upper end flange of the spool and provides a seating surface for the bottom section of a substantially identical carton disposed thereabove with its lower end portion fitted into the upper end portion of the lower carton. The pad sheet has a central opening therein providing access to handle means affixed to the spool and located within the confines of the upper end flange for manual lifting and transport of the spool by the handle means while the carton is retained on the spool by the pad sheet.

9 Claims, 9 Drawing Figures

WIRE SHIPPING AND DISPENSING PACKAGE

FIELD OF THE INVENTION

This invention relates generally to packages for the shipping and dispensing of wound wire, and more particularly to a package of the type which comprises a container of fiberboard material or the like with an open top and a wire-carrying spool disposed in the container.

BACKGROUND OF THE INVENTION

One wire dispensing and shipping package of this general type which is commonly employed in the magnet wire industry consists of a wire-carrying spool disposed vertically in a cylindrical container from the open top of which the wire may be withdrawn for the manufacture of coils or the like. Packages of this type are disclosed in U.S. Pat. Nos. 3,000,493, 3,001,642, 3,096,951, 3,811,639, 4,161,248 and 4,451,014. As shown by U.S. Pat. Nos. 3,491,876 and 3,823,894, a similar type of wire package utilizes a generally rectangular carton with top flaps which are opened to a vertical position during withdrawal of wire from the package. When shipping wire packages of the latter type, it is desirable to arrange the cartons in multiple stacks on a pallet. Since each package may weigh about 35 kilograms, the stacks may exhibit instability due to shifting of individual packages during normal shipping and handling. It would be desirable, therefore, if some means were provided in packages of this type to permit the cartons thereof to be stacked in a stable nested relationship.

Larger wire packages of the carton type which may weigh about 35 kilograms each are difficult and cumbersome to manually lift and carry to a location of use. One attempt to solve this problem has employed cutouts in the carton walls for handholds. Being of cardboard construction, the carton walls are susceptible to tearing at the cutouts when the carton is handled roughly or carelessly. In a previous patent applicaton, now U.S. Pat. No. 4,493,462 issued Jan. 15, 1985, I disclosed a molded plastic spool provided with integral handles which facilitate two-handed manual lifting of the spool. Use of such a spool in a wire package of the carton type would be advantageous if some means were provided to permit manual lifting and transport of the wire package by the spool handles while the spool remains disposed in the wire package.

SUMMARY OF THE INVENTION

The present invention provides an improved wire shipping and dispensing package having a wire-carrying spool with handle means thereon disposed in a generally rectangular carton with an open top which includes special provisions to permit stacking of several wire packages in nested relationship and to permit manual lifting and transport of the wire package by the handle means. The spool is preferably of the construction disclosed in the aforesaid U.S. Pat. No. 4,493,462 and comprises a vertical barrel, a lower end flange having a reinforced base portion, an upper end flange which is upwardly cupped, and an end plate at the upper end of the barrel which is provided with axially outwardly projecting handle means located within the confines of the upper end flange. The carton has generally vertical side and end walls defining a substantially square open top and attached to a substantially square bottom section with side and end edges of a length less than the length of the upper edges of the walls. The lower end portions of the walls converge slightly from top to bottom thereof to permit the lower end portion of the carton to frictionally fit within the upper end portion of a substantially identical carton disposed therebelow. The rim of the upper end flange is axially spaced from the upper edges of the carton walls and is engaged by a pad sheet which is removably secured in the open top of the carton. The upper side of the pad sheet provides a seating surface for the bottom section of a substantially identical carton which has its lower end portion fitted into the upper end portion of the lower carton. In a preferred embodiment, the pad sheet has a central opening therein providing access to the handle means on the spool for manual lifting and transport of the spool by the handle means while the carton is retained on the spool by the pad sheet.

Another feature of the present invention resides in the provision of top panels at the upper end of the carton which are foldable downwardly and inwardly upon the pad sheet to facilitate strapping of the package to a pallet but which may be returned to a vertical position for dispensing of wire after removal of the strapping. A further feature of the present invention resides in the provision of a carton including a self locking bottom section of four ply thickness formed from flaps integrally connected to the side and end walls of the carton. Upon folding of the flaps into an overlapped and interengaged relationship, the lower end portions of the side and end walls are automatically brought into a converging relationship.

For a better understanding of the invention, reference may be had to the following detailed description taken in connection with the accompanying drawings, in which:

DETAILED DESCRIPTION

Figure 1:
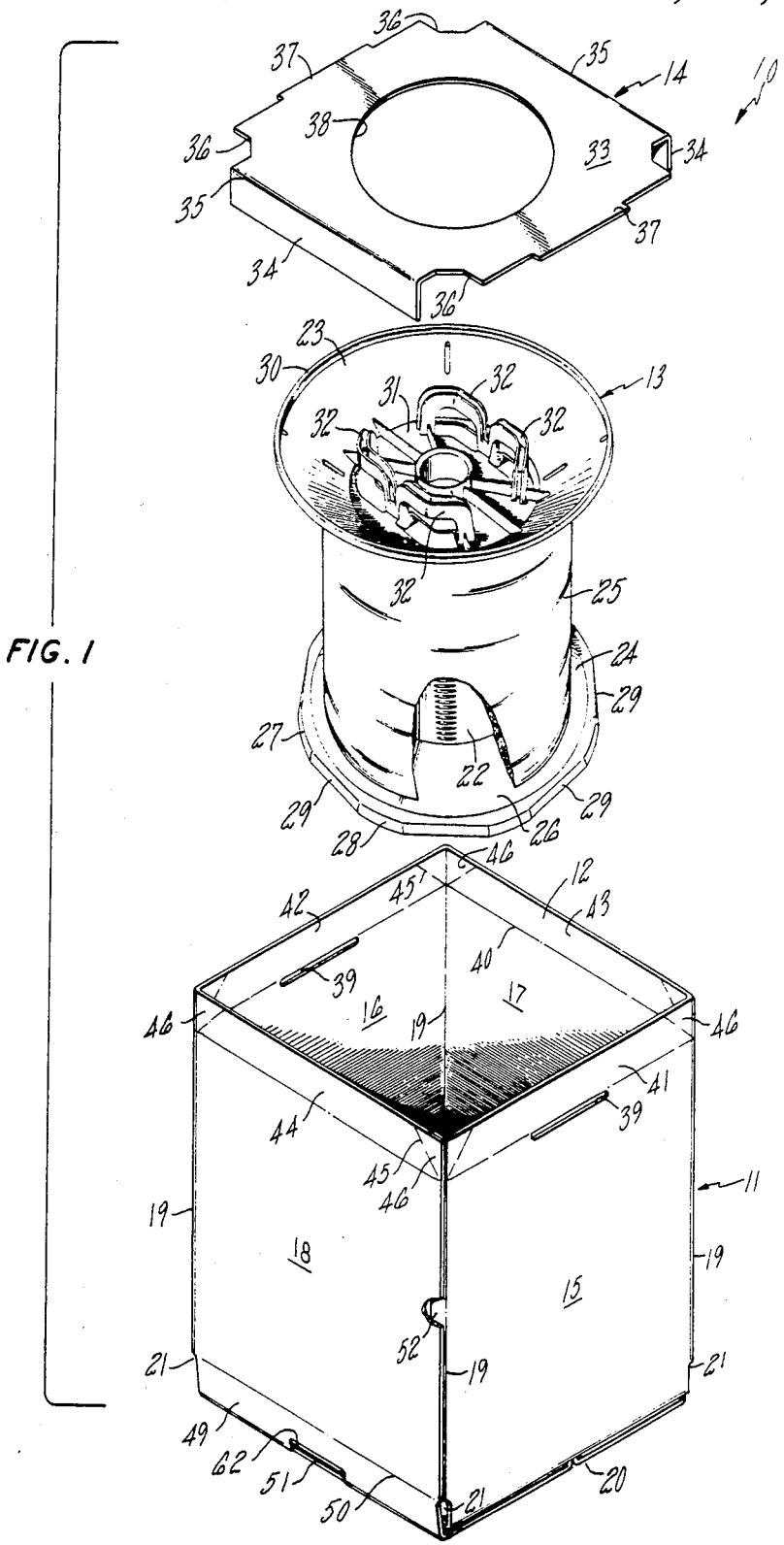
FIG. 1 is an exploded perspective view showing the pad sheet, wire-carrying spool and carton of a wire shipping and dispensing package in accordance with this invention.
Figure 2:
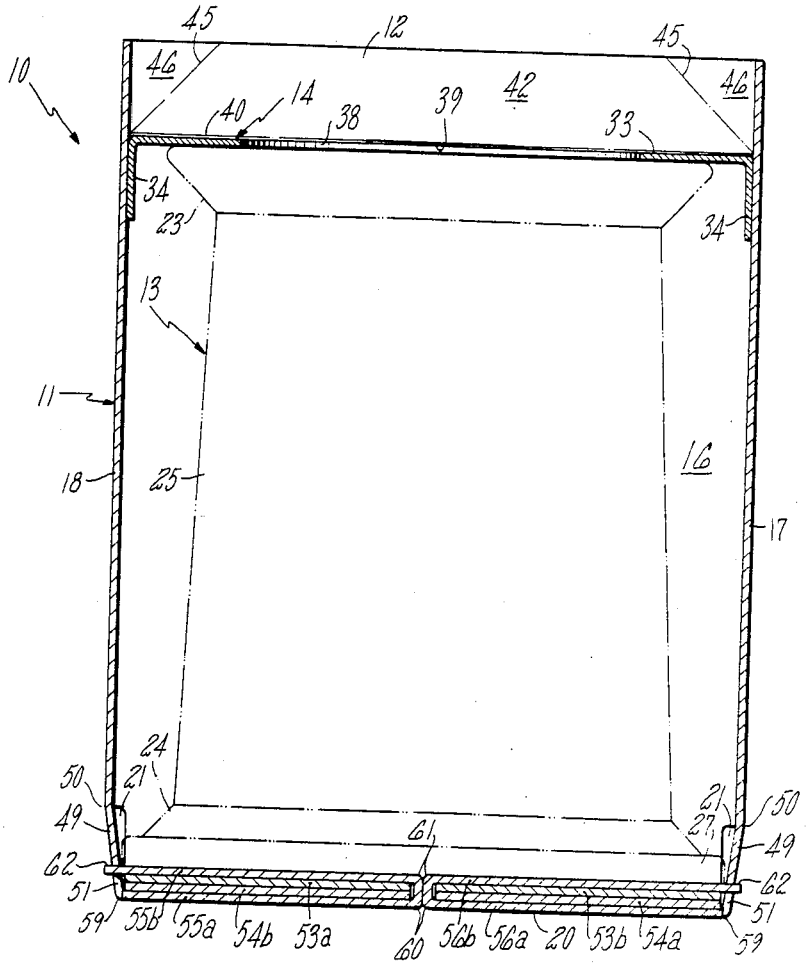
FIG. 2 is a vertical sectional view of the wire shipping and dispensing package shown in FIG. 1 showing the pad sheet and spool inserted into the carton.

Referring now to the drawings, and particularly to FIGS. 1 and 2, the improved wire shipping and dispensing package 10 includes a generally rectangular carton 11 having a substantially square open top 12, a wire-carrying spool 13 non-rotatably disposed in the carton 11 with its axis upright, and a pad sheet 14 removably secured in the open top of the carton. The carton 11 has a pair of side walls 15 and 16 and a pair of end walls 17 and 18 with adjacent walls being connected along fold lines 19. The bottom of the carton is closed by a bottom section indicated generally at 20 with side and end edges of a length less than the length of each upper edge of the walls 15–18. Adjacent sides of the walls 15–18 are separated from one another by notches 21 at the lower end of the carton 11 so that the lower edges of the walls 15–18 are shortened to a length equal to the length of the side and end edges of the bottom section 20. In addition, the lower end portions of the side walls 15 and 16 and of the end walls 17 and 18 converge slightly from top to bottom thereof to permit the lower end portion of the carton 11 to frictionally fit within the upper end portion of a substantially identical carton disposed therebelow.

The spool 13 includes a vertical barrel 22 and radially outwardly extending upper and lower end flanges 23 and 24 at the respective ends of the barrel 22 to define a space accommodating wire 25 wound about the barrel 22. The lower end flange 24 comprises a frusto-conical body 26 and a reinforced base portion 27 which includes an axially extending polygonal rim 28 with equally spaced flat surfaces 29 about its periphery. The base portion 27 has major diametral lengths between opposed pairs of the flat surfaces 29 which approximate the interior width of each side and end of the bottom section 20 of the carton 11 so that the base portion 27 may be seated upon the bottom section 20. The upper end flange 23 has a circular rim 30 formed on its outer periphery and is cupped so as to have an open side facing upwardly from the upper end of the barrel 22. A radially inwardly extending end plate 31 at the upper end of the barrel 22 has two pairs of axially outwardly projecting finger-receiving handles 32 formed integrally therewith which are located entirely within the confines of the upper end flange 23 and are arranged for manual lifting of the spool 13. Further details of such a spool are described in the aforementioned U.S. Pat. No. 4,493,462 which is incorporated herein by reference.

As can be seen from FIG. 2, the upper end flange 23 of the spool 13 has an outer diameter less than the length of each upper edge of the walls 15–18. Also the carton 11 has an internal height greater than the axial length of the spool 13 so that the rim 30 thereof is axially spaced a substantial distance from the upper edges of the walls 15–18. Thus the upper end portion of the carton 11 serves as a dereeling shroud for withdrawal of wire 25 from the spool 13 when the pad sheet 14 is removed from the carton.

Figure 3:
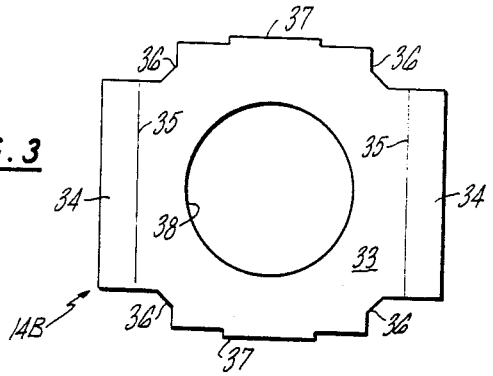
FIG. 3 is a plan view of the blank from which the pad sheet is formed.

The pad sheet 14 is formed from the blank 14B illustrated in FIG. 3 and consists of three panels or portions, namely a central portion 33 and two end portions 34 hingedly attached to respective opposite ends of the central portion 33 along perforated folded lines 35. The central portion 33 is of a generally square outline but is formed with a notch 36 at each of its corners and with a tab 37 extending outwardly from each side edge. The central portion 33 also has a central opening 38 which provides access to the handles 32 of the spool 13. Two horizontal slots 39 are punched in the side walls 15 and 16 adjacent the upper edges thereof for receiving the tabs 37. The pad sheet 14 is mounted within the open top 12 of the carton 11 with the tabs 37 inserted into the slots 39 in the side walls 15 and 16 and with the downturned end portions 34 disposed in the spaces between the upper end flange 23 of the spool and the end walls 17 and 18. The central portion 33 preferably is of a width and length such that the side edges thereof are in engagement with the side walls 15 and 16 and the end portions 34 are in engagement with the end walls 17 and 18.

The central opening 38 in the pad sheet 14 allows the handles 32 on the spool 11 to be easily grasped by the fingers of a user while the sheet pad 14 is in place. This permits the user to manually lift and transport the wire package 10 as a unit with the spool enclosed in the carton by the pad sheet. It is to be also noted that the slots 39 are suitably spaced from the upper edges of the side walls so that the lower face of the pad sheet 14 is in engagement with the rim 30 of the spool 13. This permits the upper face of the pad sheet 14 to provide a seating surface for the bottom section 20 of a substantially identical carton 10 disposed thereabove and having its lower end portion fitted into the upper end portion of the lower carton. Thus, one wire package 10 may be stacked upon another like wire package in a stable nested relation with the spool of the upper wire package supported by the spool of the lower wire package.

Although the carton 11 has an open top 12, the top margin of the carton may be folded downwardly and inwardly upon the pad sheet 14 to facilitate strapping of the wire package 10 to a pallet. A horizontal fold line 40 extends completely across all of the walls 15–18 in a plane adjacent the plane of the pad sheet 14 to define four top panels 41, 42, 43 and 44 of equal vertical heights which are substantially less than one-half the length of the upper edges of the wall 15–18. Each of the top panels 41–44 is provided at its opposite sides with fold lines 45 which each extend angularly at an angle of about 45° from a bottom corner thereof to the upper edge of the respective top panel. These angular fold lines 45 together with the vertical fold lines 19 define triangular portions 46. The adjacent triangular portions 46 at each upper corner of the carton 11 are foldably inwardly and downwardly into confronting relation to extend through a respective notch 36 in the pad sheet 14. This permits the remaining intermediate portion of each of the top panels 41–44 to be folded downwardly and inwardly flat against the pad sheet 14 as shown for the upper cartons in FIG. 4.

Figure 4:
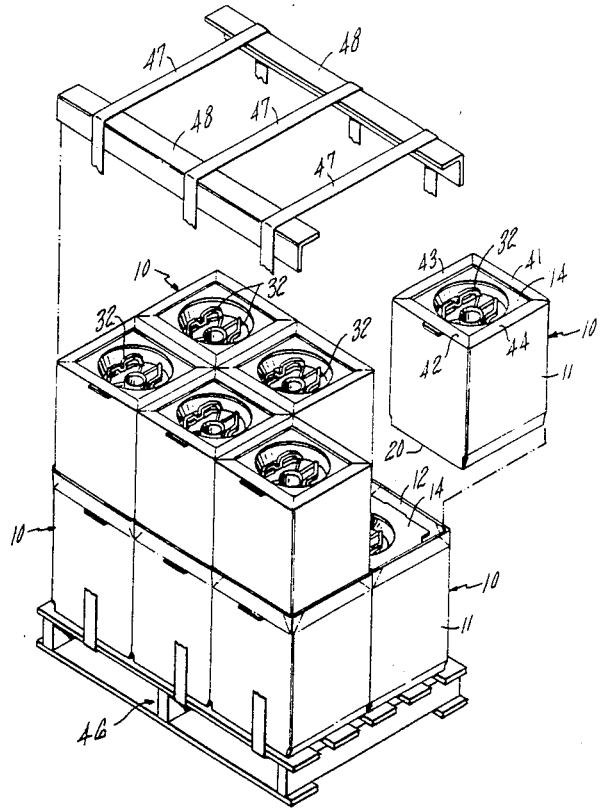
FIG. 4 is a partially exploded perspective view of a group of identical wire shipping and dispensing packages in stacked relation on a pallet and illustrating the manner in which the carton top panels of the upper wire packages are folded for strapping of the packages to the pallet.

In FIG. 4 a lower group of wire packages 10 in side-by-side relation has been stacked on a freight pallet 46 and an upper group of wire packages 10 has been stacked directly upon the lower group of wire packages. The bottom sections 20 of the cartons 11 in the upper group of wire packages rest upon the pad sheets 14 in the open tops of the cartons 11 in the lower group of wire packages with the lower end portion of each upper carton frictionally fitting into the upper end portion of a lower carton. After the wire packages are stacked in this manner, they are secured to the pallet 46 by straps 47 which preferably pass through the pallet 46 and are fastened to themselves to form continuous loops of strapping. Angle pieces 48 may be employed to prevent the straps 47 from cutting into the upper ends of the upper cartons. After shipment of the wire packages 10 to a user and removal of the straps 47 and angle pieces 48, the top panels 41–44 of each carton 11 may be returned to vertical positions and the pad sheet 14 removed for withdrawal of wire from the wire package.

The carton 11 is preferably of the folding type with a self-locking bottom section 20. The preferred carton 11 which is illustrated and discussed herein is formed from the blank 11B shown in FIG. 5. The blank 11B as well as the blank 14B for the pad sheet 14 may be cut from a suitable fiberboard or paperboard material such as double wall corrugated board.

Figure 5:
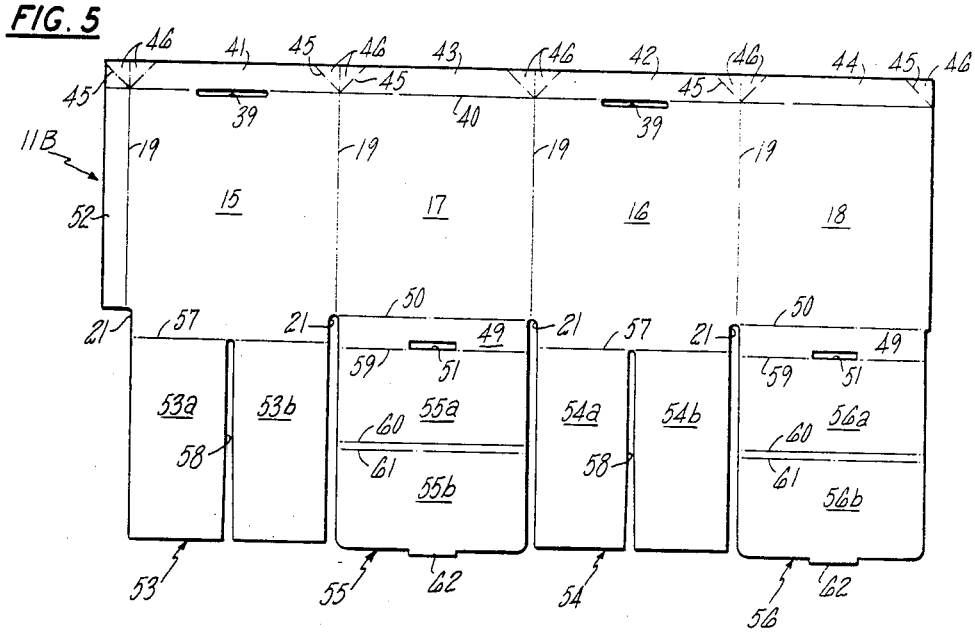
FIG. 5 is a plan view of the blank from which the carton is formed.

The panels for the walls 15–18 of the carton 11 are denoted in FIG. 5 by the same reference numerals as are used above with respect to the walls themselves. Each of the end walls 17 and 18 has a lower panel section 49 defined by a horizontal or transverse fold line 50 therein which is spaced a predetermined distance from the respective lower edge thereof so as to be aligned with the upper ends of the notches 21. A rectangular slot 51 is also cut along the lower edge of each of the end walls 17 and 18. A glue flap 52 which is attached to the side wall 15 along one fold line 19 is subsequently adhesively secured to the interior surface of the end wall 18 to convert the blank 11B into a folding carton. The bottom section 20 of the carton 11 is formed from a pair of bottom side flaps 53 and 54 and a pair of bottom end flaps 55 and 56 which are integrally connected to the respective lower edges of the side walls 15 and 16 and the end walls 17 and 18. The notches 21 separating the adjacent walls 15–18 are extended as slots to separate the corresponding adjacent flaps 53–56.

The side flaps 53 and 54 are joined to the respective side walls 15 and 16 along fold lines 57 which define the hinge lines of these side flaps with the bottom edges of the respective side walls. Each of the side flaps 53 and 54 is divided into substantially equal half panels **53*a*, 53*b* and 54*a*, 54*b*, respectively, by a central longitudinal opening 58 extending substantially from a fold line 57 the entire length of the side flap. The length of each of the half panels 53*a*, 53*b*, 54*a* and 54*b* is slightly less than the exterior width of the bottom section 20**.

The end flaps 55 and 56 are joined to the respective end walls 17 and 18 along fold lines 59 which define the hinge lines of these end flaps with the bottom edges of the respective end walls. Each of the end flaps 55 and 56 is provided with a pair of transversely extending parallel fold lines 60 and 61 spaced apart a distance approximately equal to two thicknesses of the material forming the blank 11B so as to form a narrow connecting panel between the two fold lines. The fold lines 60 are preferably perforated fold lines. It will be noted that the pairs of fold lines 60 and 61 form double hinges dividing the end flaps 55 and 56 into respective first panels **55*a* and 56*a* each hinged to the adjacent end wall and into respective second panels 55*b* and 56*b* each hinged to the first panel on its edge opposite the edge attached to the end wall. The second panels 55*b* and 56*b* each include a rectangular tab 62 extending outwardly from their respective outer edges substantially midway between their side edges. The second panels 55*b* and 56*b* further have rounded corners to facilitate folding of the flaps 53–56** into an interengaged relationship to be subsequently described.

Figure 6:
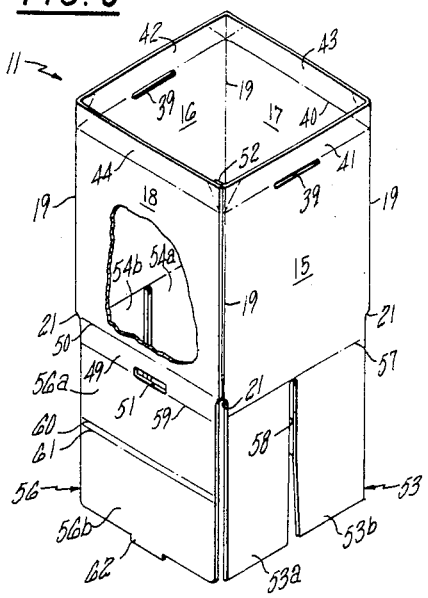
FIG. 6 is a perspective view illustrating the first step in assembling the carton from the blank shown in FIG. 5.
Figure 7:
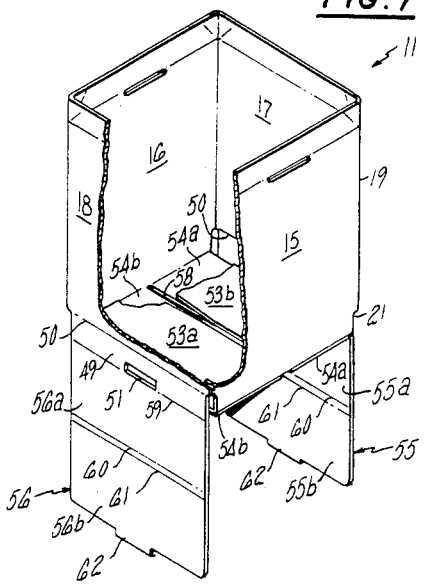
FIGS. 7, 8 and 9 are perspective views illustrating successive steps in assembling the bottom section of the carton.
Figure 8:
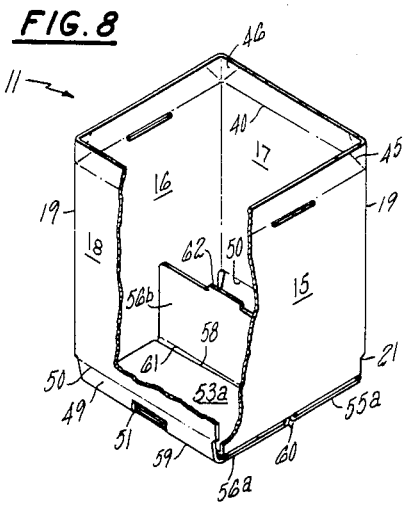

Referring now more particularly to FIGS. 6 through 9 for the assembly of the blank 11B into a finished carton 11, the blank 11B is first folded into rectangular form along the fold lines 19 as shown in FIG. 6. The glue flap 52 is overlapped with vertical edge portion of the end wall 18 and secured thereto as by gluing. As shown in FIG. 7, the side flaps 53 and 54 are then folded upwardly 90° along the fold lines 57 to substantially horizontal positions with one side flap 53 overlying the other end flap 54 and the central longitudinal openings 58 being coincident.

Next the end flaps 55 and 56 are folded inwardly along the fold lines 60 and 61 to provide the first end flap panels **55*a* and 56*a* and the second end flap panels 55*b* and 56*b*. Then the end flaps 55 and 56 are folded inwardly along the fold lines 59 and at the same time the second panels 55*b* and 56*b* are inserted through the coincident longitudinal openings 58 in the side flaps 53 and 54 to the generally vertical positions shown in FIG. 8. With the second panels 55*b* and 56*b* in these positions, the first panels 55*a* and 56*a* are in confronting abutting relation with the respective adjacent half panels 54*a* and 54*b* of the lower side flap 54 and the narrow connecting portions of the end flaps 55 and 56 between the fold lines 60 and 61 extend vertically in side-by-side relation through the longitudinal openings 58 in the side flaps 53 and 54. During insertion of the second panels 55*b* and 56*b* through the openings 58, the lower panel sections 49 of the end walls 17 and 18 are each bent inwardly along a fold line 50** so as to incline inwardly from the top to bottom thereof.

Figure 9:
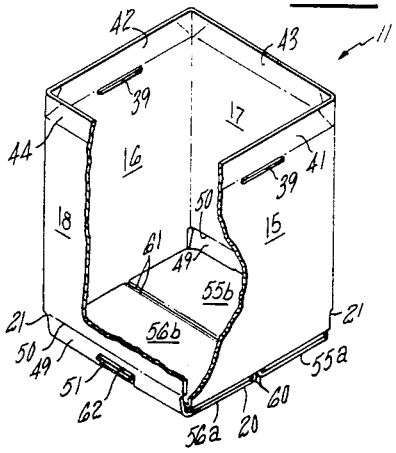

In the final assembly step, the second panels **55*b* and 56*b* are folded downwardly into confronting abutting relation with the respective adjacent half panels 53*b* and 53*a* of the upper side flap 53 to overlie the respective first panels 55*a* and 55*b*. At the same time, the tabs 62 on the second panels 55*b* and 56*b* are forced into the slots 51 in the end walls 17 and 18 to automatically lock the parts of the bottom section 20 in place as shown in FIG. 9. Because the side flaps 53 and 54 are shorter in length than the width of the end walls 17 and 18 above the notches 21, the lower end portions of the side walls 17 and 18** between the notches also converge slightly from top to bottom thereof.

While the principles of this invention has been described in connection with a preferred embodiment, it is to be understood that this description is made only by way of example and not as a limitation to the scope of the invention.

What is claimed is:

1. In a wire shipping and dispensing package including a generally rectangular carton having a substantially square open top, a wire-carrying spool non-rotatably disposed in said carton with the axis thereof upright, and a pad sheet removably secured in said open top of the carton above the spool; said carton comprising a substantially square bottom section, and a pair of opposed end walls and a pair of opposed side walls extending generally upwardly from the edges of the bottom section to define said open top at their upper edges; the end walls being joined with and extending between the side walls; said spool comprising a vertical barrel having at the upper end thereof a radially inwardly extending end plate and a radially outwardly extending upper end flange, and having adjacent the lower end thereof a radially outwardly extending lower end flange; the lower end flange having a reinforced base portion for seating upon said bottom section of the carton; the upper end flange having a circular rim formed on its outer periphery and being cupped so as to have an open side facing upwardly from the upper end of the barrel; the end plate being provided with axially outwardly projecting handle means which are located entirely within the confines of the upper end flange and arranged for manual lifting of the spool; the improvement wherein: the side and end edges of said bottom section each have a length less than the length of each upper edge of said side walls and end walls; the lower end portions of said side walls and end walls each converging slightly from top to bottom thereof to permit the lower end portion of said carton to frictionally fit within the upper end portion of a substantially identical carton disposed therebelow; said base portion of the spool having major diametrical lengths approximating the interior width of each side and end of said bottom section of the carton and being seated upon said bottom section; said upper end flange having an outer diameter less than the length of each upper edge of said side walls and end walls; said carton having an internal height greater than the axial length of the spool whereby the rim of said upper end flange is axially spaced a substantial distance from the upper edges of said side walls and end walls; said pad sheet engaging the rim of said upper end flange and providing a seating surface for the bottom section of a substantially identical carton disposed thereabove and having its lower end portion fitted into the upper end portion of the lower carton.

2. The invention of claim 1 wherein said pad sheet has a central opening therein providing access to said handle means for manual lifting and transport of the spool by said handle means with the spool enclosed in said carton by said pad sheet whereby the wire shipping and dispensing package may be manually transported as a unit.

3. The invention of claim 1 wherein said side walls and end walls each have a horizontal fold line therein located in a common plane adjacent to the plane of said pad sheet and defining top panels which are foldably downwardly and inwardly upon the pad sheet; said top panels having equal vertical heights that are substantially less than one-half of the length of the upper edges of the carton; adjacent sides of said top panels being joined to each other by vertical fold lines; each of said top panels having fold lines extending angularly from the bottom corners thereof to the upper edge thereof and defining with said vertical fold lines triangular portions which are foldable downwardly and inwardly into the carton; said pad sheet having notches formed therein at the corners thereof configured to permit adjacent triangular portions of said top panels to be folded downwardly and inwardly into said carton whereby the portions of said top panels intermediate said triangular portions may be folded inwardly flat against said pad sheet.

4. The invention of claim 1 wherein said pad sheet comprises a generally square central portion and two end portions hingedly attached to respective opposite ends of the central portion; said end portions being downturned and engaging the end walls of the carton; said central portion having opposed side edges engaging the side walls of the carton and a tab extending outwardly from each of the side edges thereof; said side walls of the carton being provided with two corresponding horizontal slots for receiving said tabs to removably secure said pad sheet in said carton.

5. The invention of claim 4 wherein said central portion of the pad sheet has a central opening therein providing access to said handle means for manual lifting and transport of the spool by said handle means while said carton is retained on the spool by the pad sheet.

6. The invention of claim 1 wherein the lower edges of said side walls and end walls are shorter in length than said upper edges thereof and adjacent sides of said end walls and side walls are separated from one another at the lower end portion of the carton; each of said end walls having a horizontal fold line therein spaced a predetermined distance from the lower edge thereof and defining a lower panel section which is inclined inwardly from top to bottom thereof.

7. The invention of claim 6 wherein said bottom section comprises two substantially rectangular end flaps integrally connected to the lower edges of said end walls and foldable upwardly and two substantially rectangular side flaps integrally connected to the lower edges of said side walls and foldable upwardly; each of said side flaps being hinged to one of the side walls and having a central longitudinal opening extending substantially from its side wall hinge to divide said side flap into substantially equal half panels each extending a distance slightly less than the width of said bottom section; each of said end flaps being hinged to one of the end walls and having transverse double-hinge fold line means therein to provide a first panel hinged to the adjacent end wall and a second panel hinged to the first panel on its edge opposite the edge attached to the end wall; said double-hinge fold line means including a narrow connecting panel intermediate the first and second panels; each of said second panels being provided with an outwardly extending tab at its outer edge substantially midway between its side edges; said end walls being provided with two corresponding horizontal slots adjacent the bottom edges thereof for receiving said tabs; said side flaps being disposed in a horizontal confronting abutting relation with the central longitudinal openings therein being coincident with each other; each of said first panels being folded into confronting abutting relation with the adjacent half panel of the lower one of said side flaps; the narrow connecting panels of said end flaps extending in side-by-side relation through the central longitudinal openings in said side flaps; each of said second panels being folded to a position overlying the first panel hinged thereto and into confronting abutting relation with the adjacent half panel of the upper one of said side flaps; said tabs being engaged in said slots in the end walls to secure said end flaps in assembled relation with said side flaps.

8. A generally rectangular carton formed from a one-piece blank of fiberboard material comprising:

a substantially square bottom section, a pair of opposed end walls and a pair of opposed side walls extending generally upwardly from the edges of the bottom section to define at their upper edges a substantially square open top of greater area than the area of the bottom section; the end walls being joined with and extending between the side walls; adjacent end and side walls at their lower ends being separated from each other by notch means whereby the lower edges of the end walls and side walls are shorter in length than the upper edges thereof; each of the end walls having a horizontal fold line therein spaced a predetermined distance from the lower edge thereof and defining a lower panel which is inclined inwardly from top to bottom thereof; the lower end portions of the side walls also converging slightly from top to bottom thereof to to permit the lower end portion of the carton to frictionally fit within the upper end portion of a substantially identical carton disposed therebelow; said bottom section comprising two substantially rectangular end flaps integrally connected to the lower edges of the end walls and foldable upwardly and two substantially rectangular side flaps integrally connected to the lower edges of the side walls and foldably upwardly; each of said side flaps being hinged to one of the side walls and having a central longitudinal opening extending substantially from its side wall hinge to divide said side flap into substantially equal half panels each extending a distance slightly less than the width of said bottom section; each of said end flaps being hinged to one of the end walls and having transverse double-hinge means therein to provide a first panel hinged to the adjacent end wall and a second panel hinged to the first panel on its edge opposite the edge attached to the end wall; said double-hinge fold line means including a narrow connecting panel intermediate the first and second panels; each of said second panels being provided with an outwardly extending tab at its outer edge substantially midway between its side edges; said end walls being provided with two corresponding horizontal slots adjacent to the bottom edges thereof for receiving said tabs; said side flaps being disposed in a horizontal confronting abutting relation with the central longitudinal openings therein being coincident with each other; each of said first panels being folded into confronting abutting relation with the adjacent half panel of the lower one of said side flaps; the narrow connecting panels of said end flaps extending in side-by-side relation through the central longitudinal openings in said side flaps; each of said second panels being folded to a position overlying the first panel hinged thereto and into confronting abutting relations with the adjacent half panel of the upper one of said side flaps; said tabs being engaged in said slots in the end walls to secure said end flaps in assembled relation with said side flaps.

9. The carton of claim 8 wherein said side walls and end walls each have a horizontal fold line therein located in a common plane spaced from said upper edges and defining top panels which are foldable downwardly and inwardly; said top panels having equal vertical heights that substantially less than one-half the length of the upper edges of the carton; adjacent sides of said top panels being joined to each other by vertical fold lines; each of the top panels having fold lines therein extending angularly from the bottom corners thereof and defining with said vertical fold lines triangular portions which are foldable downwardly and inwardly into the carton with adjacent triangular portions in confronting relation whereby the portions of said top panels intermediate said triangular portions may be folded inwardly to lie flat along said common plane.

* * * * *